US011723482B2

(12) United States Patent
Godinger

(10) Patent No.: US 11,723,482 B2
(45) Date of Patent: Aug. 15, 2023

(54) SPINNING DRINKING VESSEL

(71) Applicant: Godinger Silver Art Ltd., Ridgewood, NY (US)

(72) Inventor: Arnold Godinger, Brooklyn, NY (US)

(73) Assignee: Godinger Silver Art Ltd., Ridgewood, NY (US)

( * ) Notice: Subject to any disclaimer, the term of this patent is extended or adjusted under 35 U.S.C. 154(b) by 331 days.

(21) Appl. No.: 17/016,274

(22) Filed: Sep. 9, 2020

(65) Prior Publication Data

US 2022/0071419 A1 Mar. 10, 2022

(51) Int. Cl.

| | |
|---|---|
| ***A47G 19/22*** | (2006.01) |
| ***B01F 29/31*** | (2022.01) |
| ***B01F 29/80*** | (2022.01) |
| *B01F 101/17* | (2022.01) |

(52) U.S. Cl.

CPC ..... *A47G 19/2227* (2013.01); *B01F 29/31* (2022.01); *B01F 29/80* (2022.01); *A47G 2400/045* (2013.01); *B01F 2101/17* (2022.01)

(58) Field of Classification Search

CPC ... A47F 5/02; A47G 19/2205; A47G 19/2227; A47G 23/08; A47G 2400/045; B01F 2101/17; B01F 29/31; B01F 29/80; B01F 33/50111; B01F 33/5014; B01F 35/3202

USPC ..... 220/605

See application file for complete search history.

(56) References Cited

U.S. PATENT DOCUMENTS

| | | | | |
|---|---|---|---|---|
| 4,442,948 | A * | 4/1984 | Levy | A47G 19/2227 206/218 |
| 6,491,183 | B1 | 12/2002 | Huang | |
| 6,585,119 | B2 * | 7/2003 | Palder | A47F 5/02 211/49.1 |
| 9,784,405 | B1 * | 10/2017 | Bushkovskiy | F16M 13/02 |
| 2001/0000617 | A1 | 5/2001 | Tracy | |
| 2016/0007781 | A1 * | 1/2016 | DeNinno | A47G 19/2227 206/457 |
| 2018/0055256 | A1 | 3/2018 | Parentini | |
| 2018/0255949 | A1 * | 9/2018 | Fritz | A47G 19/2227 |

FOREIGN PATENT DOCUMENTS

CN 109953588 A * 7/2019

OTHER PUBLICATIONS

International Search Report and Written Opinion of the International Searching Authority in International Appl. No. PCT/US2021/049684, dated Dec. 16, 2021, 7 pages.

* cited by examiner

*Primary Examiner* — James N Smalley
*Assistant Examiner* — Madison L Poos
(74) *Attorney, Agent, or Firm* — Bochner PLLC; Andrew D. Bochner

(57) ABSTRACT

A drinking vessel for holding liquids, having a base engaged with a rotation platform, the rotation platform having two parts in rotational engagement and configured to enable the drinking vessel to spin.

18 Claims, 5 Drawing Sheets

SPINNING DRINKING VESSEL

BACKGROUND

Generally, drinking vessels are cylindrical, and while they are frequently made of glass and may therefore be transparent, a person usually can only properly see one side of the drinking vessel at a time. Even if one looks through the drinking vessel to see the opposite side, the view will be reversed. It is possible, of course, to rotate a drinking vessel, but this often involves picking it up, otherwise one risks scratching the surface of the table on which the drinking vessel is placed. Even if one is unconcerned with scratching the table, perhaps because the glass is smooth, the glass may make a squeaky sound as it rubs against the table surface, which is inelegant.

Additionally, there is the risk that the drinking vessel may topple over by rotating it in this crude manner. Moreover, since the drinking vessel may feature an aesthetically pleasing design which takes advantage of the circular and therefore continuous spread of the canvas of the drinking glass, one may wish to repeatedly rotate the drinking vessel, which can be tiring, thereby detracting from the aesthetic appeal.

Aeration of a wine, via a wine glass, is often a manual process involving rotating or swishing around the wine in the glass. This process is imprecise—many individuals do not understand how to properly aerate a glass of wine, and may instead actually spill the wine over the edges.

Moreover, aeration of wine is usually done via a stemmed glass, such that an individual may gently swirl the wine around the glass using the stem. However, stemmed glasses are formal, large, and can often break. To solve this, individuals may turn to stemless glasses, such as those in the "Old Fashioned" style. However, stemless glasses require the individual to manually stir the glass by rotating their hand, which causes hand fatigue and soreness.

It is desirable, therefore, to provide devices and methods for rotating the drinking vessel easily, with the possibility of many rotations without needing to reactivate the rotation mechanism.

It is further desirable to provide devices and methods for properly aerating a glass of wine while removing user error.

It would be further desirable to provide devices and methods for providing aeration of a wine glass without the need for a stemmed glass, while also reducing hand fatigue and soreness.

SUMMARY

This application describes a drinking vessel coupled to a rotation platform. The drinking vessel is designed to contain beverages or liquid foods for drinking or consumption. The drinking vessel may be a beaker, beer glass, wineglass, coffee cup, jar, mug, stemware, teacup, or tumbler. The drinking vessel may be formed of glass, but may conceivably be made of metal, plastic, or ceramic. The drinking vessel is also small enough such that it can be held by a user with one hand.

DETAILED DESCRIPTION

Figure 1:
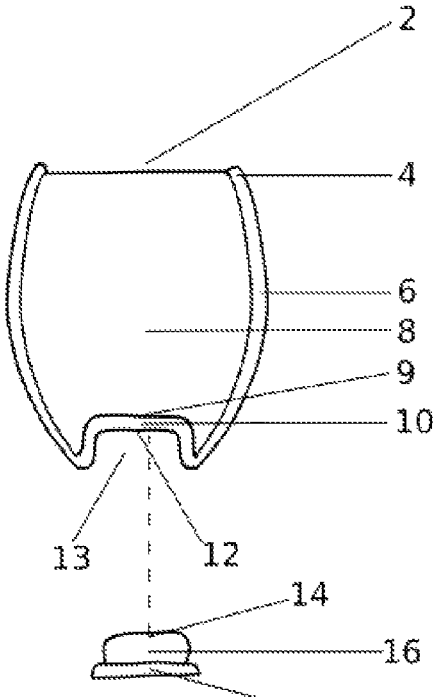
FIG. 1 illustrates a cross-sectional view of the drinking vessel and the rotation platform.

As disclosed herein, the invention includes a drinking vessel that may be coupled to, or used with, a rotation platform. The drinking vessel is designed to contain beverages or liquid foods for drinking or consumption. The drinking vessel may be a beaker, beer glass, wineglass, coffee cup, jar, mug, stemware, teacup, or tumbler. The drinking vessel may be formed of glass, but may conceivably be made of metal, plastic, or ceramic. The drinking vessel is also small enough such that it can be held by a user with one hand. The drinking vessel may reduce hand fatigue and soreness by eliminating the need for swirling a glass manually. That is, by providing a base of ball bearings that assists in rotating the glass, aeration is provided.

The drinking vessel may include one or more primary walls, a lip, and a base, with the one or more primary walls disposed between the lip and the base. A cavity is formed by the one or more primary walls, lip, and base. The cavity may extend from each portion of the one or more primary walls to its opposite portion, and from the top face of the base to the lip of the drinking vessel.

The one or more primary walls may include an outer face and an inner face, with the inner face oriented toward the cavity and the outer face designed to be held by the user. The one or more primary walls may be single-walled, in which case no air pocket is disposed between the inner and outer faces. In one variation, the one or more primary walls are double-walled, such that an air pocket is disposed between the inner and outer faces, thereby reducing the heat transfer coefficient, impeding the warmth of the user's hand from melting any ice disposed within the cavity, as well as impeding the user's hand from getting burnt by any hot liquid contained therein.

The drinking vessel may be substantially cylindrical, and therefore may encompass a perimeter extended over the height of the drinking vessel. This perimeter, by extending over the height of the drinking vessel, may form the one or more primary walls. The shape may be truly cylindrical, in having a circular cross-section, or the cross section may be polygonal, with three, four, five, six, seven, eight, nine, or ten sides. Any two given sides may extend toward each other and merge at side junctions. The junctures may have small radii, less than a tenth of an inch—in other words, the junctures may be substantially unrounded. Alternatively, the junctures may have large radii, producing a substantially rounded-polygonal cross-section. A truly cylindrical cross-section will have no sides, and therefore no side junctures, but instead one single circumference.

The perimeter may change its radius, in the case of it being substantially circumferential, or average width, in the case of the cross-section being polygonal, as it extends from the base to the lip. The perimeter may increases as it passes along the primary walls away from the base toward the middle of the primary walls. In one embodiment, the perimeter continues to increase as it passes along the primary walls from the middle to the lip. In another variation, the perimeter decreases as it passes along the middle to the lip, in order to provide the relatively narrow lip common in snifters.

The one or more primary walls extend from the drinking vessel base to the drinking vessel lip. The lip is configured to touch the lips of the user when the user drinks from the drinking vessel, and is therefore preferably smooth and rounded, with the rounded shape continuing around the lip from the outer face of the one or more primary walls to the inner face.

The drinking vessel base may be weighted—an effect achieved by increasing the thickness of the base relative to the drinking vessel primary walls. The base may include a top and bottom face, with the top face oriented toward a drinking vessel cavity, which is formed at least by the one or more primary walls and base of the drinking vessel. The bottom face may be oriented toward any hard surface which the drinking vessel may be placed upon, such as a table, nightstand, chair, or the floor. The bottom and/or top face may each be essentially contoured, with the top face being concave, convex, or neither concave nor convex. In one embodiment, the base features a stem, in which a column, which may be straight or curved, connects the top face and the bottom face.

The bottom face may include an indentation, the indentation extending upward toward the top face. The indentation may be circular, having a height of 0.25-0.75 inches and a diameter between 75-99% of the base as a whole. The indentation is configured to receive and rest upon a rotation platform. The rotation platform may include a fixed portion and an unfixed portion, with the unfixed rotationally connected to and engaged with the fixed portion. The fixed portion has a terminal surface configured to be placed atop a flat surface, such as a table, nightstand, chair, or the floor. The terminal surface may be covered at least partly in felt or other soft material in order to prevent the formation of scratches on the flat surface.

The unfixed portion may be shaped to fit the indentation, and should therefore also be circular but slightly smaller in diameter than the indentation. The matching circular indentation may enable the bottom face of the drinking vessel to be fitted to the unfixed portion of the rotation platform regardless of degrees around the polar axis extending through both.

The surface contact between the unfixed portion and the bottom face of the base may provide sufficient friction to prevent rotation between the two. This friction may exceed the friction between the unfixed portion and the fixed portion to enable the drinking vessel and the unfixed portion to synchronously rotate with respect to each other while rotating with respect to the fixed portion. Similarly, the friction between the fixed portion and the flat surface may be greater than the friction between the unfixed portion and the bottom face of the base.

In certain embodiments, the indentation and unfixed portion are not circular but some other shape, such as a square, star, or triangle. In other embodiments, the indentation and unfixed portion each have a symmetrical cross section, such that multiple correct fittings are possible to engage them. In yet additional embodiments, the indentation and unfixed portion each have an asymmetrical cross section, such that only a single correct fitting is possible to engage them. In both versions, rotation between the unfixed portion and the bottom face of the base is impossible.

In a variation, the bottom face indentation extends downward away from the top face, and is configured to be inserted into or otherwise engage with the unfixed portion.

The unfixed portion is rotationally coupled to the fixed portion via an overlapping ring construction, in which a transverse ring of the unfixed portion is disposed concentrically with and conforms to a ring of the fixed portion. A set of ball bearings may be disposed between the fixed portion ring and unfixed portion ring in order to facilitate rotation. One or more independent rings may operate as intermediaries between the ball bearings and either ring in order to better contain the ball bearings, which may be greased in order to lubricate rotation.

The drinking vessel primary wall may feature an image and/or text that only displays itself in full to a user in a fixed position as the drinking vessel rotates with respect to the fixed portion. The image may include a spiral formation, configured to give the illusion that the lines are spiraling upwards during rotation.

In certain embodiments, rotation of the drinking vessel about the base may cause aeration of a drink, such as wine, within the glass. That is, in some embodiments, the unfixed portion and the fixed portion may synchronously rotate with respect to one another, causing the wine to swirl around within the glass properly without spelling over, and thereby properly aerating.

As shown in FIG. 1, the drinking vessel 2 features a lip 4 connected to the base 10 by a primary wall 6. The base features a top face 9 which faces the cavity 8 and a bottom face 12 which faces away from the cavity. The bottom face forms an indentation 13, which is configured to receive the rotation platform 16, and is configured to be flush with the unfixed portion 14 of the rotation platform. The unfixed portion is rotationally engaged to the fixed portion 18 so that the unfixed portion can spin relatively freely with respect to the fixed portion while still being attached to it.

Figure 2:
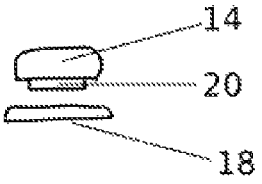
FIG. 2 illustrates the rotation platform separated into the fixed and unfixed portions.
Figure 3:
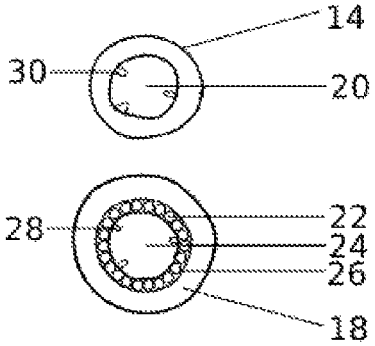
FIG. 3 illustrates a bottom view of the unfixed portion and a top view of the fixed portion.

As shown in FIG. 2, the unfixed portion engages with the fixed portion by a transverse ring 20 that extends from the unfixed portion into the fixed portion. As shown in FIG. 3, the transverse ring may be surrounded by or surround a ring of ball bearings 22, which facilitate rotation between the transverse ring and a receiving ring 26. The transverse ring may lock into a ring cavity 24 via a set of locking beads 28, which may protrude into the cavity and catch inverse locking beads 30 which indent the transverse ring 20.

Figure 4:
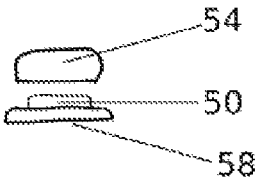
FIG. 4 illustrates an embodiment of the rotation platform separated into the fixed and unfixed portions.
Figure 5:
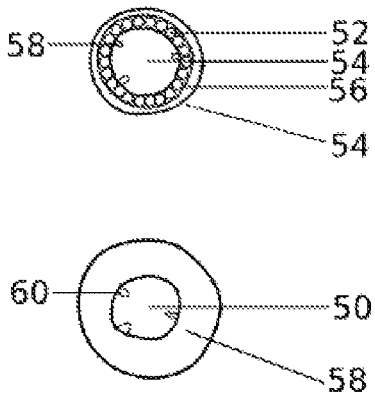
FIG. 5 illustrates a bottom view of an embodiment of the unfixed portion and a top view of an embodiment of the fixed portion.
Figure 7:
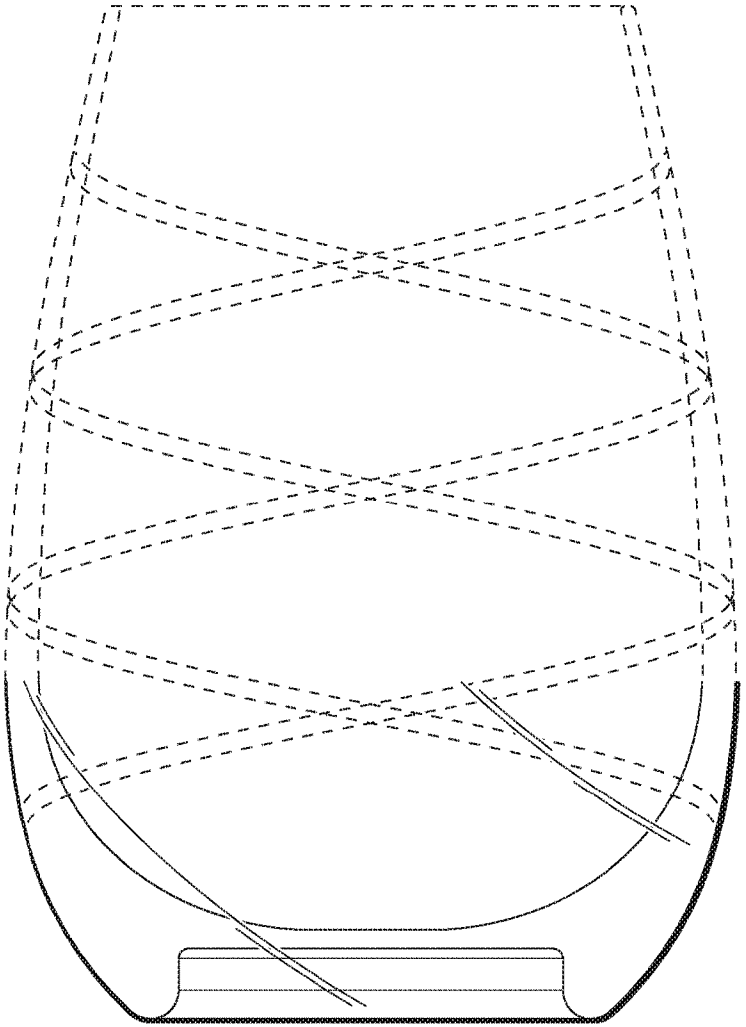
FIGS. 6-8 illustrate various side views of the drinking vessel.
Figure 6:
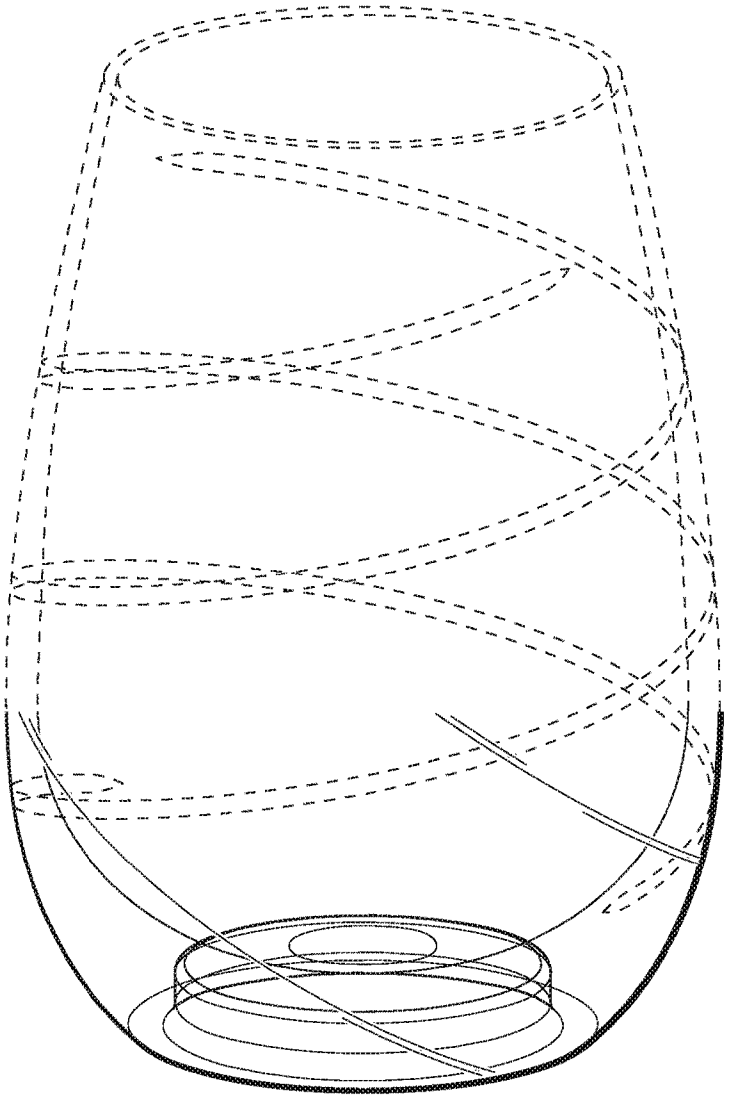
Figure 9:
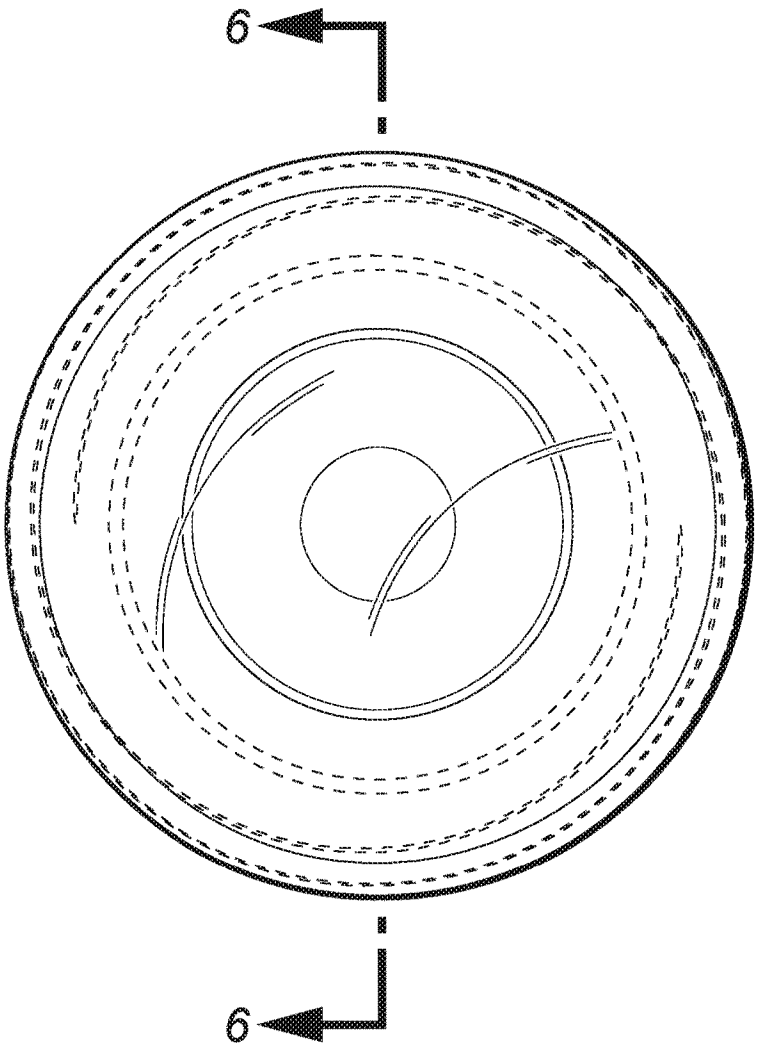
FIG. 9 illustrates a top view of the drinking vessel.
Figure 8:
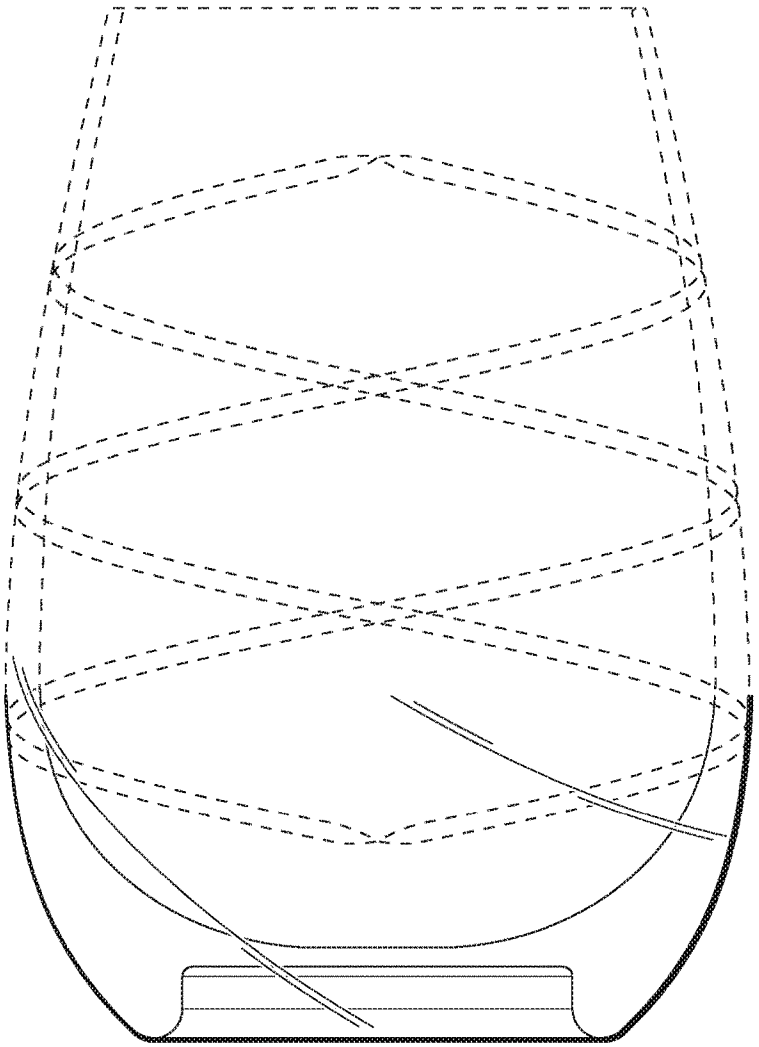
Figure 11:
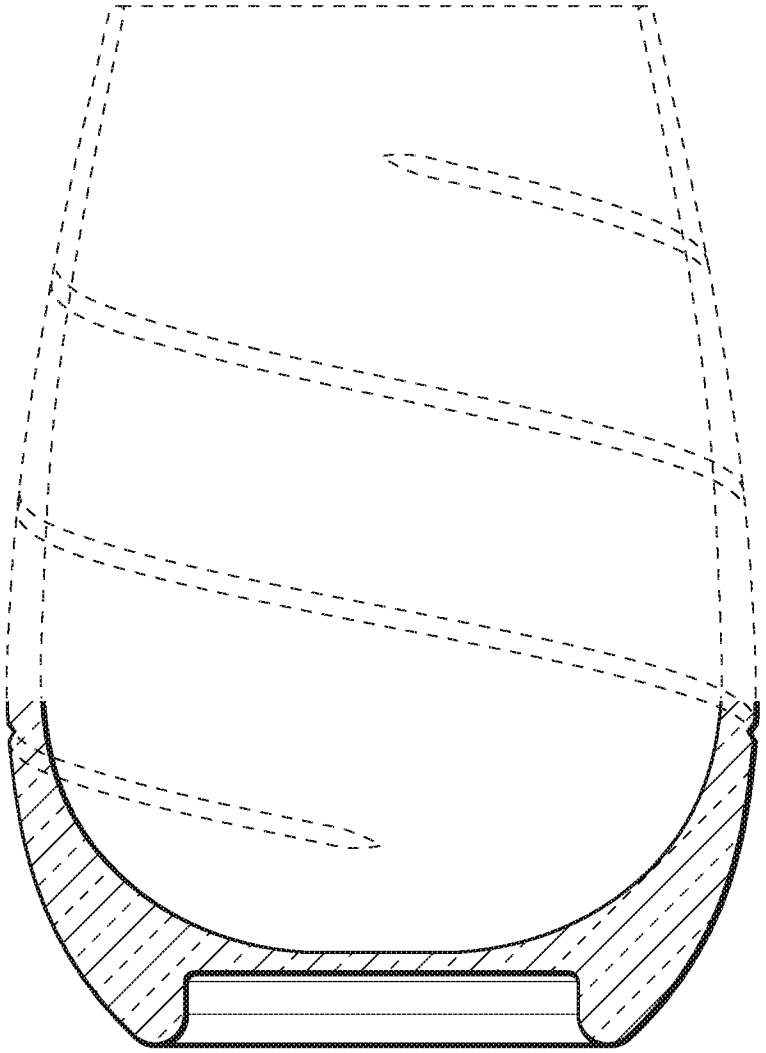
FIG. 11 illustrates a side view of the drinking vessel.
Figure 10:
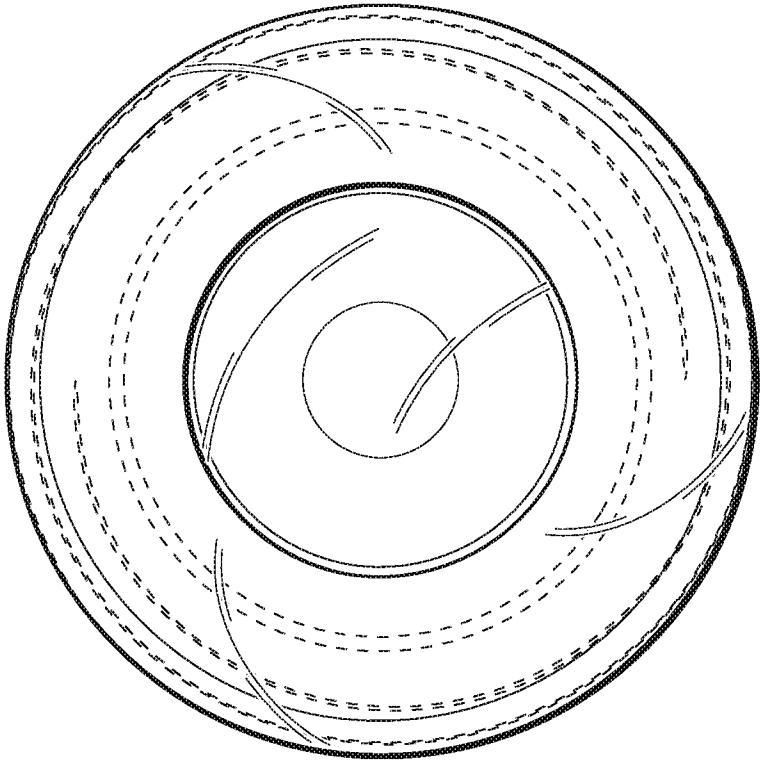
FIG. 10 illustrates a bottom view of the drinking vessel.
Figure 12:
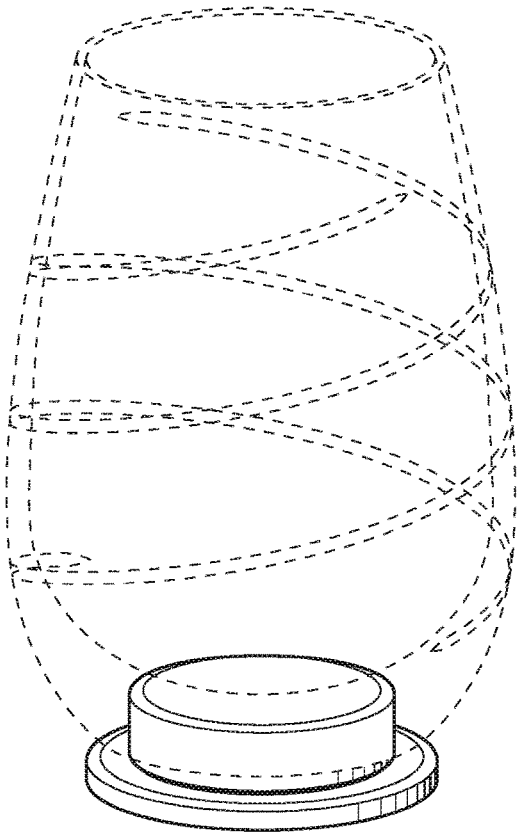
FIG. 12 illustrates a top front perspective view of the rotation platform.
Figure 14:
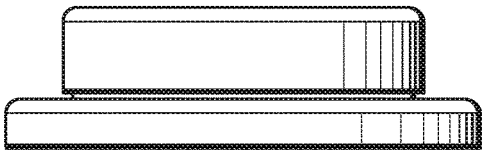
FIG. 14 illustrates a side view of the rotation platform.
Figure 15:
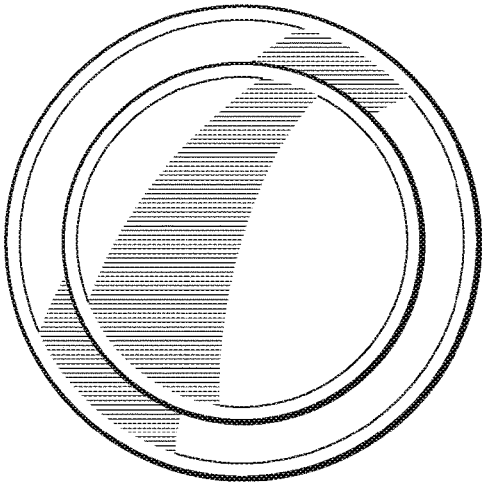
FIG. 15 illustrates a top view of the rotation platform.
Figure 13:
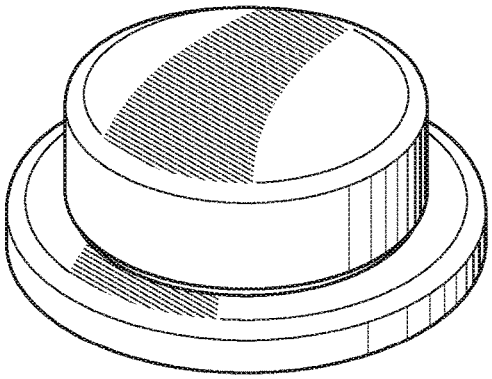
FIG. 13 illustrates a top front perspective view of the rotation platform.
Figure 16:
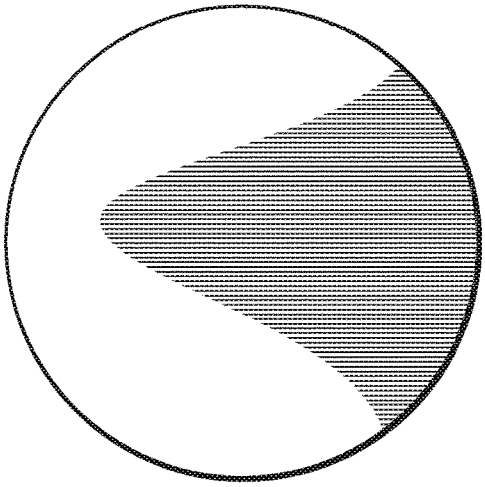
FIG. 16 illustrates a bottom view of the rotation platform.

In a variation shown in FIG. 4, the unfixed portion 54 engages with the fixed portion 58, with a transverse ring 50 extending from the fixed portion into the unfixed portion. In this variation, as shown in FIG. 5, the unfixed portion has a receiving ring 56, in which a ring of ball bearings 52 is positioned. The ring of ball bearings surround a ring cavity 54, into which the transverse ring 50 is configured to enter. The transverse ring may lock into the ring via the coupling of locking beads 58 and inverse locking beads 60. It is also conceivable that the positioning of the locking beads and the inverse locking beads are reversed, such that the inverse locking beads are positioned in the ring cavity and the locking beads are positioned on the transverse ring 50.

While this invention has been described in conjunction with the embodiments outlined above, many alternatives, modifications and variations will be apparent to those skilled in the art upon reading the foregoing disclosure. Accordingly, the embodiments of the invention, as set forth above, are intended to be illustrative, not limiting. Various changes may be made without departing from the spirit and scope of the invention.

What is claimed is:

1. A drinking vessel to be used by a drinker for drinking liquids and designed to spin, comprising a lip, at least one primary wall, a base, and a rotation platform;

a. the lip configured to be in contact with a drinker's mouth;

b. the at least one primary wall being disposed between and connecting the lip and the base, configured to be held by a drinker's hand, and having an inner face and an outer face, the inner face oriented toward a vessel cavity, the outer face configured to be in contact with the drinker's hand;

c. the base configured to be placed on a hard surface and having a top face and a bottom face, the bottom face oriented toward the hard surface and the top face oriented toward the vessel cavity;

d. the vessel cavity being disposed within a boundary formed by the lip, the at least one primary wall, and the base, and having a center, the center being equidistant from opposite portions of the at least one primary wall;

e. the rotation platform comprising a fixed portion and an unfixed portion, the fixed portion and the unfixed portion being rotationally engaged and locked together via a set of locking beads and a set of inverse locking beads;

f. the base additionally comprising an indentation extending into the bottom face towards the vessel cavity and configured to receive the top face of the unfixed portion, wherein a friction between the top face of the unfixed portion and the bottom face of the base, and a friction between the fixed portion and the hard surface, are greater than a friction between the unfixed portion and the fixed portion;

g. the friction interface between the unfixed portion and the fixed portion comprising a receiving ring coupled to a transverse ring, with a ring of ball bearings disposed between the receiving ring and the transverse ring.

2. A drinking vessel to be used by a drinker for drinking liquids and designed to spin, comprising a lip, at least one primary wall, a base, and a rotation platform;

a. the lip configured to be in contact with a drinker's mouth;

b. the at least one primary wall being disposed between and connecting the lip and the base, configured to be held by a drinker's hand, and having an inner face and an outer face, the inner face oriented toward a vessel cavity, the outer face configured to be in contact with the drinker's hand;

c. the vessel cavity being disposed within a boundary formed by the lip, the at least one primary wall, and the base;

d. the base configured to rotationally engage with the rotation platform;

e. the rotation platform comprising a fixed portion and an unfixed portion, the fixed portion and the unfixed portion being rotationally engaged; and f. the fixed portion and unfixed portion being locked together via a set of locking beads and a set of inverse locking beads.

3. The drinking vessel of claim 2, wherein a friction between the top face of the unfixed portion and the bottom face of the base is greater than a friction between the unfixed portion and the fixed portion.

4. The drinking vessel of claim 3, the fixed portion configured to be placed on a hard surface, wherein a friction between the fixed portion and the hard surface is greater than a friction between the unfixed portion and the fixed portion.

5. The drinking vessel of claim 2, the friction interface between the unfixed portion and the fixed portion comprising a receiving ring coupled to a transverse ring, with a ring of ball bearings disposed between the receiving ring and the transverse ring.

6. The drinking vessel of claim 5, the receiving ring attached to the unfixed portion and the transverse ring attached to the fixed portion.

7. The drinking vessel of claim 5, the transverse ring attached to the unfixed portion and the receiving ring attached to the fixed portion.

8. The drinking vessel of claim 2, the vessel cavity having a center, the center being equidistant from opposite portions of the at least one primary wall.

9. The drinking vessel of claim 2, the rotation platform comprising a motor and a power source, the motor configured to rotate the unfixed portion with respect to the fixed portion.

10. The drinking vessel of claim 2, the base comprising an indentation extending into a bottom face towards the vessel cavity and configured to receive the rotation platform.

11. The drinking vessel of claim 2, rotation platform comprising an indentation configured to receive the base.

12. The drinking vessel of claim 2, the at least one primary wall of the drinking vessel having a circumference and an ornamental design or text spanning at least 50% of the circumference.

13. The drinking vessel of claim 12, the ornamental design or text spanning at least 70% of the circumference.

14. The drinking vessel of claim 13, the ornamental design or text spanning at least 95% of the circumference.

15. The drinking vessel of claim 12, the drinking vessel having a lower portion near the base and a higher portion near the lip, the ornamental design comprising lines that extend from the lower portion to the higher portion at an angle of 30-60 degrees from the base.

16. The drinking vessel of claim 2, the at least one primary wall being made of glass.

17. A drinking glass configured to hold liquids and comprising a base and a rotation platform, the rotation platform comprising a top portion and a bottom portion, the base configured to have a greater friction interface with the top portion of the rotation platform then the top portion has with the bottom portion, the top portion configured to spin freely with the bottom portion, wherein the top portion and bottom portion are locked together via a set of locking beads and a set of inverse locking beads.

18. The drinking glass of claim 17, the drinking glass having a circumference and an ornamental design spanning at least 70% of the circumference.

* * * * *